United States Patent [19]

Matthews

[11] Patent Number: 5,031,368

[45] Date of Patent: Jul. 16, 1991

[54] TILES FOR FALSE FLOORS

[76] Inventor: Anthony W. Matthews, 3 Hunter Street, Yarralumla, Australian Capital Territory, 2600, Australia

[21] Appl. No.: 444,164

[22] PCT Filed: Apr. 29, 1988

[86] PCT No.: PCT/AU88/00123

§ 371 Date: Dec. 11, 1989

§ 102(e) Date: Dec. 11, 1989

[87] PCT Pub. No.: WO88/08474

PCT Pub. Date: Nov. 3, 1988

[30] Foreign Application Priority Data

Apr. 29, 1987 [AU] Australia ..... PI1648

[51] Int. Cl.[5] ..... E04B 5/58

[52] U.S. Cl. ..... 52/126.6; 52/598; 52/263

[58] Field of Search ..... 52/126.6, 263, 598, 52/599

[56] References Cited

U.S. PATENT DOCUMENTS

| | | | |
|---|---|---|---|
| 1,710,413 | 4/1929 | Evans | 52/599 |
| 2,797,448 | 7/1957 | Revell et al. | 52/598 X |
| 3,181,486 | 5/1965 | King | 52/599 X |
| 3,213,533 | 10/1965 | Lynam et al. | 52/598 X |
| 3,759,009 | 9/1973 | Ransome | 52/598 |
| 4,051,642 | 10/1977 | Terry | 52/263 X |
| 4,067,156 | 1/1978 | Downing, Jr. | 52/126.6 |
| 4,621,468 | 11/1986 | Likozar | 52/126.6 |
| 4,745,715 | 5/1988 | Hardwicke et al. | 52/126.6 |
| 4,833,845 | 5/1989 | Bruckner et al. | 52/126.6 |
| 4,901,490 | 2/1990 | Zinniel et al. | 52/263 |

*Primary Examiner*—Robert L. Wolfe
*Assistant Examiner*—Suzanne L. Dino
*Attorney, Agent, or Firm*—Armstrong, Nikaido, Marmelstein, Kubovcik & Murray

[57] ABSTRACT

A tile for use in the construction of a false floor consists of a rectangular tray into which concrete is poured. The tray is of metal, a strong plastic material or any other suitable material. The concrete is preferably pliable concrete. The tray has a diagonal ridge which has a cross-sectional shape of a narrow inverted V, extending into the concrete. Preferably the tray has at least one shear pin extending from the floor of the tray into the concrete, to reinforce the bond between the concrete and the material of the tray. The side walls of the tray may be shaped to provide an additional key for the concrete, which also reinforces that bond. To form a false floor, the tile is placed on pedestals located under each corner of the tile. If the tops of the pedestals are not coplanar, pressure on the upper surface of the tile causes the triangular portions on each side of the ridge to move relative to each other about the line of the ridge, until all four corners of the tile contact the tops of their associated pedestals.

15 Claims, 4 Drawing Sheets

TILES FOR FALSE FLOORS

TECHNICAL FIELD

This invention concerns tiles. More particularly it concerns tiles used to create false floors. False floors, in this specification, are floors which are supported above a true floor or above a roof on pedestals. Among the purposes for which a false floor may be constructed are:

(a) to provide a trafficable surface over a roof or over a floor requiring protection;

(b) to provide a space in which heat insulation or sound attenuation members can be located; and (c) to provide a cavity for electrical wiring or other services.

BACKGROUND ART

At present, false floors are constructed of rectangular slabs or tiles which are supported on packing blocks or column supports set under the four corners of each slab or tile. Typically, these slabs or tiles are pre-cast reinforced concrete members or are pressed steel members filled with concrete or particle board. Unless the floor or roof above which the false floor is located is planar and the column supports are of uniform height, the slabs or tiles are not supported on all four supports simultaneously. Planar floors and uniform column supports, however, are rare and either the slabs or tiles rock about the pivot provided by two of the supports, or each slab has to be supported on adjustable jacks at each corner or has to be carefully packed to ensure that it is supported evenly on all four supports. Rocking slabs produce an unsatisfactory false floor. Careful jacking or packing at each support, however, adds considerably to the cost of the installation of the false floor.

To overcome this problem it has been proposed to use rectangular tiles or slabs which can flex or deform about a diagonal of the tile to ensure that all the corners of each of the two triangular sub-tiles rest upon a pedestal or support for the false floor. For example, the specification of French patent No. 2,294,293 discloses rectangular tiles which are constructed as triangular sub-tiles, hinged together. Each sub-tile has the shape of a right-angled triangle. The sub-tiles are joined together by a flexible material embedded within the sub-tiles, so that the hypotenuse of one sub-tile is adjacent to, but spaced a small distance from the hypotenuse of the other sub-tile. The flexible material acts as a hinge between the two sub-tiles, allowing a small inclination of the plane of one sub-tile relative to the plane of the other sub-tile.

Several other examples of a deformable tile have been described in the specification of International patent application No. PCT/AU85/00270, which was published as WIPO publication No. W086/02969. Each rectangular, concrete tile or slab illustrated and described in that specification is provided with a line of weakness in the tile or slab, located along a diagonal of the rectangle. The line of weakness may be a groove formed in the concrete of the tile or slab or in a reinforcing steel pan of the tile or slab. The inclusion of a hinge connecting two triangular sub-tiles is also suggested in WIPO publication No. W086/02969.

DISCLOSURE OF THE PRESENT INVENTION

The present invention is an improved tile or slab for use in constructing false floors, in which there is provision for deformation of the tile along a diagonal of the tile. The tile comprises a rectangular tray of strong, sheet-type material (such as metal or a strong plastic material) into which concrete has been formed. A ridge, in the shape of an inverted V, extending along a diagonal of the tile, is formed in the floor of the tray. This ridge provides a line of deformation along the diagonal of the underside of the tile and a strengthening of the tile in the orthogonal direction.

If the tile is supported on four pedestals (one at each corner) which do not have upper surfaces which are precisely coplanar, and pressure is applied to the upper surface of the tile, the tile will deform along the line of the inverted v-shaped ridge until each corner of the tile is resting securely on the top of a pedestal.

Thus, according to the present invention, there is provided a tile for use in the construction of a false floor, the tile comprising a rectangular tray made from a strong sheet material into which concrete has been cast, characterised in that (a) the floor of the rectangular tray is shaped to provide a ridge which extends across a diagonal of the tile, the ridge having a cross-sectional shape which is the shape of an inverted V, and (b) under the application of pressure to the tile, the region of the tile on one side of the ridge is moveable about an axis which coincides with the crest of the ridge, relative to the region of the tile on the other side of the ridge.

Preferably the concrete used in the tile is pliable concrete, being concrete which includes glass fibres of pieces of a polymer material. The fibreglass or polymer material is included in the concrete mix prior to the casting of the tile.

Preferably the tray is made from steel or a hard plastic material. Preferably, the inverted v-shaped groove extends into the tile a distance which is at least two thirds of the thickness of the concrete of the tile.

If the tile is formed using a steel tray or pan, the pan is preferably provided with (i) at least one shear pin extending from the base of the pan, and (ii) edges which are shaped to form a returned rebate in the steel. These features are useful in restricting the relative movement of the concrete and the steel tray or pan.

In a development useful for rapid construction of a false floor of substantial area, a large square tile having dimensions which are preferably about 600 mm by 600 mm is created by effectively connecting together a 2×2 array of sub-tiles, each sub-tile having the construction of the tile of the present invention, except that the side walls of the sub-tiles do not extend around the entire sub-tile. The side walls of the sub-tiles which would be adjacent to the side walls of two other tiles in the array are each replaced by a further ridge in the tray or pan of the large square tile, having a cross-sectional shape which is that of an inverted V.

With such an arrangement of ridges, if this large tile is supported on a 3×3 matrix of pedestals, the upper surfaces of which are not precisely co-planar, and pressure is applied to the upper surface of the large tile, the large tile will deform, as necessary, along the line of each inverted v-shaped ridge until the large tile rests on the top of each pedestal.

This reference to a large tile is not intended to imply that the basic tile of the present invention is restricted in any way in its dimensions. The basic tile may measure more than 600 mm×600 mm, if required.

Thus, according to a second aspect of the present invention, there is provided a tile or slab for use in the construction of a false floor, comprising a rectangular tile of concrete supported within a tray of strong sheet material, characterised in that (a) the tile is divided into a 2×2 array of sub-tiles by a pair of inverted v-shaped ridges in the tray, each ridge extending in a direction which is parallel to two sides of the tile and at right angles to the direction in which the other ridge extends; and (b) the region of the tray which comprises the base of each sub-tile is shaped to provide an inverted v-shaped ridge, extending along a diagonal of the sub-tile.

It is desirable to construct the large tile with four elongate shallow indentations in the underside of the tile, each such indentation extending parallel to a respective edge of the tile and being spaced from that respective edge only a short distance. These shallow indentations are useful for providing channels for cables underneath a false floor constructed using the large tiles.

These features, and other optional features, will be described in more detail in the following discussion of embodiments of the present invention, in which reference will be made to the accompanying drawings.

DETAILED DESCRIPTION OF THE ILLUSTRATED EMBODIMENTS

Figure 1:
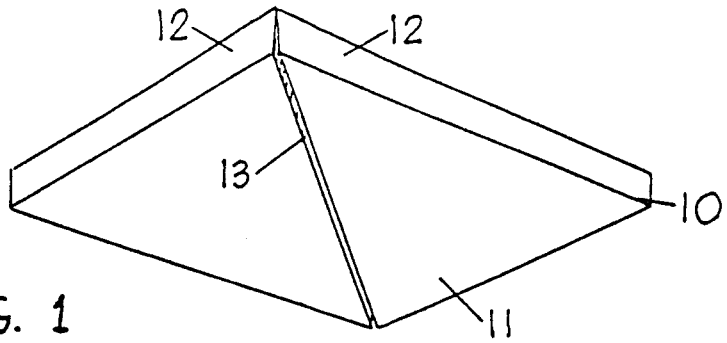
FIG. 1 is perspective sketch showing the underside of the basic tile of the present invention.
Figure 2:
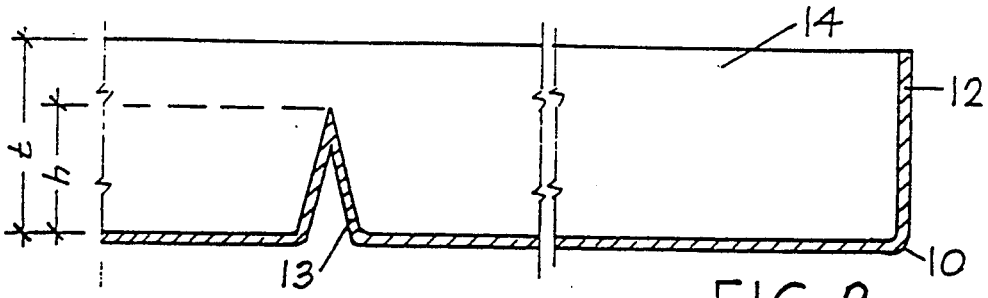
FIG. 2 PRIOR ART
FIG. 2 is a sectional view through a portion of the tile of FIG. 1.

The tile illustrated in FIGS. 1 and 2 consists of a rectangular tray 10 made of metal (preferably steel), or of a strong plastic or a similar sheet material, having a floor 11 and side walls 12. The floor of the tray is pressed or moulded so that a ridge 13, having the cross-sectional shape of an inverted letter V, extends across a diagonal of the tray. The tray is filled with concrete 14, which (as noted above) is preferably pliable concrete.

Typically the tile will have a thickness of about 12 mm.

The height of the inverted v-shaped ridge 13 is preferably such that the ratio of the height h of the apex of the ridge to the thickness t of the concrete in the tray or pan 10 is at least 2:3, and may be 1:1 (that is, the ridge may extend to the top of the concrete in the tray 10).

The opening at the base of the inverted V will usually be in the range of from 0.5 mm to 1.5 mm, when the tile has a thickness of about 12 mm and the ridge has a height of from 8 to 10 mm.

If a tile of the type shown in FIGS. 1 and 2 is placed on four pedestals, with each pedestal being underneath a corner of the tile, and the top surfaces of the pedestals are not entirely coplanar, the tile can only be in contact with three of the pedestals. If pressure is then applied to the top surface of the tile, the line of the apex of the ridge 13 will act as an axis about which the portions of the tile on each side of the ridge will move relative to each other, until all four corners are in contact with the top surfaces of their respective associated pedestals. Such deformation of the tile (which is similar to the deformation of the tile shown in FIGS. 4 and 5 of WIPO publication No. WO86/02969) enables a firm false floor region to be provided by the tile, even though the true floor on which the pedestals rest is not flat.

Those persons familiar with the casting of concrete against metal surfaces will be aware that there is a tendency for the bond between the concrete and the metal surface to be destroyed when the assembly is subjected to shear forces. It is preferable, therefore, for the tile of the present invention to include at least one shear pin extending from the floor 11 of the tray 10 and projecting into the concrete 14, and for the side walls 12 of the tray to be shaped to assist in maintaining intact the bond between the concrete and the metal tray. A preferred location for shear pins is above the edges of the pedestals which support the corners of the tile, but they should also be included in other positions in the tile where the larger shear forces occur.

Figure 3:
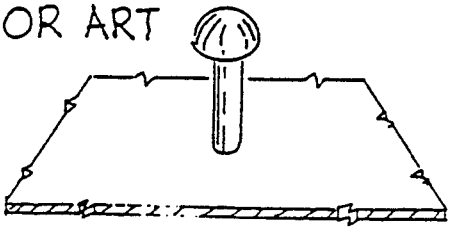
FIG. 3 PRIOR ART
FIGS. 3 and 4 are perspective sketches of known types of shear pin that may be used with the present invention.
Figure 4:
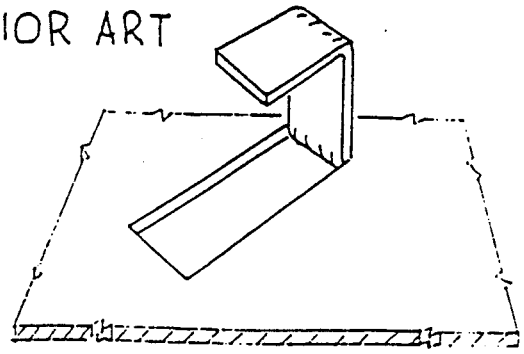

Conventional shear pins may be (a) a steel stud, similar to a bolt, which is welded or otherwise securely connected to the floor of the tray or pan and which may have an enlarged head at the end thereof which is furthest from the steel pan, as shown in FIG. 3;

(b) a rectangular strap cut into the floor of a steel pan and bent to be at right angles to the plane of the pan, preferably with a return bend in the end of the strap, as shown in FIG. 4; or (c) a cylindrical projection from the floor of a tray or pan which is created by penetrating the steel sheet with a tool of circular or similar shape in such a way that it draws the metal into a cylindrical shape standing up from the planar surface of the tray floor.

Figure 5:
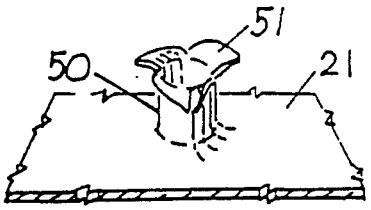
FIG. 5 is a perspective sketch of a novel and preferred form of shear pin that may be used with the present invention.

However, the preferred form of shear pin is one which has been developed by the present inventor and comprises an upright cylindrical projection from the floor of the steel pan, terminating in three or more "ears" which extend outwardly beyond the outer diameter of the cylindrical projection. Such a shear pin is illustrated in FIG. 5 (and is also included in the arrangements featured in FIGS. 6 and 7). It comprises a hollow cylinder 50 terminating in a plurality of ears 51. This type of shear pin is fabricated by driving a tool having a circular cross-section and a multi-edged cutting end through the floor 11 of the steel tray 10. The number of edges on the cutting end of this tool determine the number of ears 51 that are formed as part of the shear pin. The cutting edges are concavely curved so that they turn the ends of the ears 51 outwards after the steel pan has been ruptured during the drawing of the body portion (the cylindrical region 50) of the shear pin.

Figure 6:
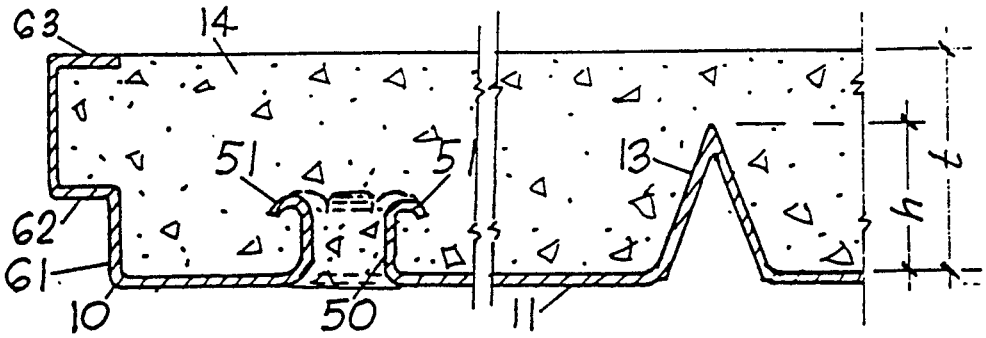
FIGS. 6 and 7 are sectional views through edge regions of tiles of the type shown in FIGS. 1 and 2 but with modified side walls, each tile including a shear pin of the type shown in FIG. 5.

FIG. 6 is a schematic diagram showing a shear pin of the type illustrated in FIG. 5 and an inverted v-shaped ridge both formed in a steel tray 10. The tray or pan 10 also has a wall 61 with a rebate section 62 which is returned by an upper flange 63 which extends inwardly from the wall, parallel to the floor 11 of the steel tray or pan 10. Concrete 14 poured into a pan having these features has its bond with the steel floor strengthened by the returned rebate portion 63 of the wall 61, which also stiffens the edge of the tray (and hence provides additional strength to the edges of a tile constructed in accordance with the general arrangement illustrated in FIGS. 1 and 2.

Figure 7:
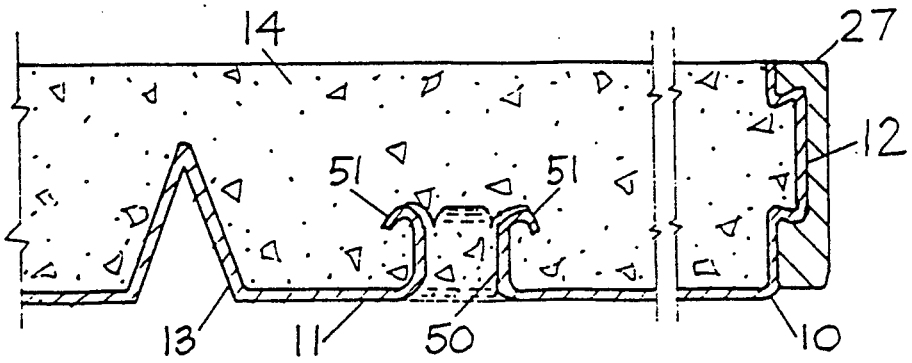

FIG. 7 is similar to FIG. 6, the difference between the two embodiments residing in a modified form of the side wall of the tray 10 with its rebate and return. The side wall of the tray in the tile construction shown in FIG. 7 is a generally dovetail shape, which provides strength to the wall, reinforces the bond between the concrete and the metal tray, and enables an edge strip 27 (typically of a resilient plastic or rubber-based material) to be fitted to the edges of the tile. Other convenient side wall shapes include an inverse form of the dovetail shape shown in FIG. 7 and a double rebate arrangement created by an inwardly extending groove in the side wall, around the entire periphery of the tile.

Figure 8:
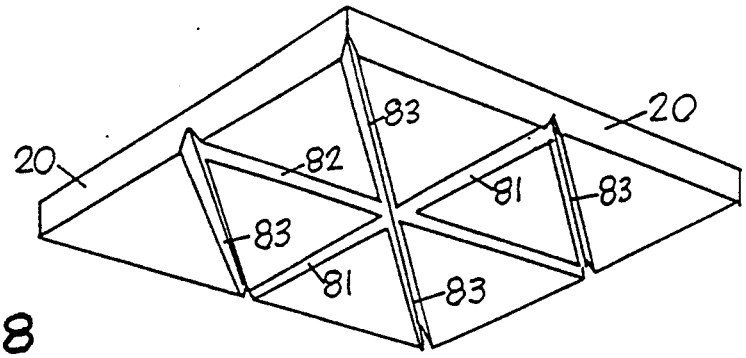
FIGS. 8 and 9 are perspective sketches showing the undersides of two large tiles constructed in accordance with the second aspect of the present invention.
Figure 9:
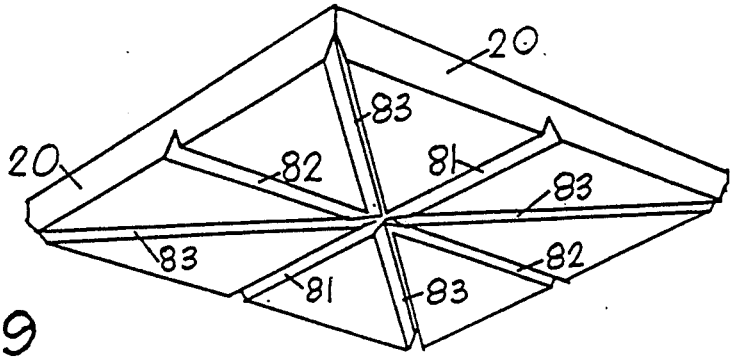

FIGS. 8 and 9 each show the underside of a large tile constructed in accordance with the second aspect of the present invention. As shown in these Figures, the metal, plastic or equivalent tray 20 has pressed or moulded in it a plurality of ridges, each having a cross-sectional shape which is substantially that of an inverted V. Two of these ridges, ridges 81 and 82, each extend from the mid-point of one of the edges of the tile to the mid-point of the opposite edge of the tile, to form a cross-shaped groove arrangement which divides the tile into what is conveniently regarded as four rectangular sub-tiles. The sub-tiles are, in effect, a $2\times2$ array of sub-tiles. Each sub-tile has a diagonal ridge 83 formed in that portion of the tray or pan 80 that defines its underside. The diagonal ridges 83 are parallel to each other in the embodiment of FIG. 8, but define a diagonal cross in the underside of the tile of FIG. 9.

If the tile of FIG. 8 or 9 is placed on a $3\times3$ array of pedestals (located at (a) the four corners of the tile, (b) the mid-points of each edge of the tile, and (c) at the central point of the tile where the ridges 81 and 82 intersect each other) and the tops of the pedestals are not precisely coplanar, the tile will deform when a force is applied to its upper surface until the tile is resting upon the top of each pedestal. The deformation occurs, of course, in the regions of the tile which are immediately above the apexes of the inverted v-shaped ridges 81, 82 and 83. That is, the tile deforms about the ridges in the underside of the tile until each triangular region created by the ridges rests upon three of the pedestals. With such deformation, a firm false floor region is created by the tile, even though the tops of the pedestals which support the tile are not precisely coplanar. A carpet or other floor covering may then be placed on top of the tile.

Figure 11:
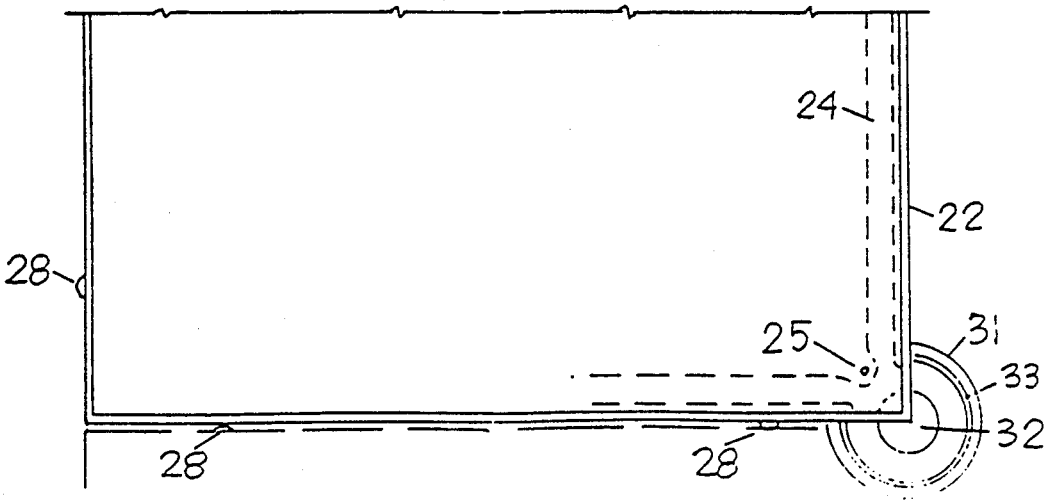
FIG. 11 is a schematic plan view, of the portion of the tile shown in FIG. 10.
Figure 10:
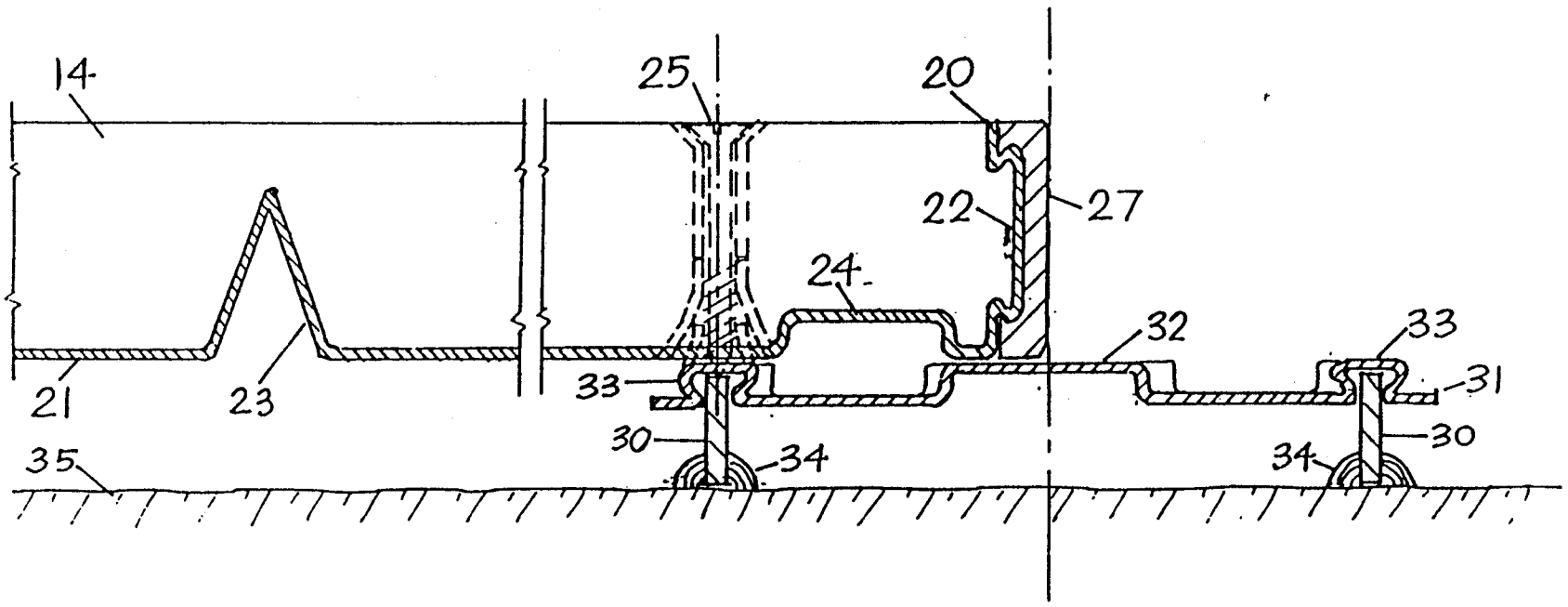
FIG. 10 is a sectional view illustrating the preferred construction of the large tiles of FIGS. 8 and 9.

The tile shown in part only in FIGS. 10 and 11 is a modified form of the tile of FIG. 8 or 9, and is formed by pouring concrete 14 into a steel pan or tray 20. The concrete used in this realisation of the invention is preferably pliable concrete, created by including a polymer material in the concrete mix prior to casting in the pan 20.

The pan 21 is pressed to create its walls 22 and the inverted v-shaped ridges 23 in the underside of the tile. In the tile shown in FIGS. 10 and 11, the steel pan is also given an upwardly extending indentation 24 a short distance in from, and parallel to, each edge of the tile. The indentations 24 are used to form part of a wiring channel for the false floor formed when a number of tiles are mounted above a floor on pedestals of low height. The indentations 24 also have a structural purpose—they provide an additional key between the concrete and the tray of the tile. Apertures 25 (one near each corner of the tile) are created in both the steel pan 20 and the concrete 14, to receive screws which are used to secure the tile to pedestals or pedestal caps (see the description below) on which the tile is supported.

The steel walls 22 of the tile may have any one of a number of suitable configurations (examples have been given in FIGS. 2, 6 and 7). In the embodiment shown in FIG. 10, the steel walls 22 of the pan 20 have been formed into a dovetail shape 26, so that an edge strip 27, of a plastic material, having a complementary dovetail shape, may be mounted on the edge of the tile. Alternatively, each steel wall 22 may receive at least one plastic button 28, as shown in FIG. 4. The plastic button or buttons 28 will usually be positioned in one half of a respective steel wall 22, so that they can be used as spacers between tiles when a false floor is assembled.

FIGS. 10 and 11 also illustrate a preferred form of support for the tiles of the second aspect of the present invention when they are used to construct a false floor. In this preferred mounting arrangement, the corners of each tile are supported upon one quarter of an annular pedestal 30 on which is mounted a pedestal cap 31. The central region 32 of the pedestal cap 31 is raised up, and it is upon this central region 32 that the corner of the steel pan 21 rests. The pedestal cap 31 also has an annular raised region 33 which defines a circular slot in the underside of the pedestal cap, which receives the pedestal 30. The dimensions of the pedestal 30 and the pedestal cap 31 are such that a screw inserted through the aperture 25 can pass through a corresponding aperture in the raised region 33 of the pedestal cap and tap into the pedestal 30. Normally the pedestal 30 will be bonded to the true floor 35 (above which the false floor is to be assembled) using adhesive fillets 34.

The pedestals 36 used to support the mid-points of each edge of the steel pan and the centre of the steel pan are preferably in the form of thimbles mounted with their closed ends on the true floor 35 and their open ends bearing against the underside of the steel pan 20. A button of rubber, neoprene or similar material may be placed between each pedestal 36 and the true floor 35. The uppermost part of each pedestal 36 may be provided with a flange upon which the steel pan 21 rests, or may extend, in whole or in part (for example, by being formed as a castellated edge) into a groove or series of grooves in the underside of the tray or pan 20.

A strong plastic material, or an equivalent sheet material, may be used instead of steel for the pan or tray 21 of the large tiles illustrated in FIGS. 8, 9, 10 and 11.

Architects, civil engineers and builders will appreciate that the embodiments illustrated in the drawings and described above are but examples of the present invention and as such they may be modified or varied without departing from the present inventive concept.

INDUSTRIAL APPLICATION OF THE PRESENT INVENTION

The prime use of the present invention is in the production of false floors. In this application of the invention, the fact that tiles constructed in accordance with the second aspect of the present invention can be readily created with dimensions 600 mm×600 mm×12 mm makes them well suited for the refurbishing of old offices, where ceilings are lower than is usual in modern office blocks.

An additional use of the present invention is in the construction of bullet or impact resistant screens and enclosures. Such screens and the membranes (walls, floors, ceilings) of such enclosures should be able to deflect a little when struck by a bullet, and then vibrate to absorb the force of impact. Panels for use in such screens and membranes will have a strong steel backing to a pliable concrete or plastic facing material. A bullet penetrating the pliable concrete or other facing material would be retarded before impacting against the steel backing. Provided a reasonable thickness of pliable concrete is used, there is sufficient energy loss in this medium to permit a relatively thin sheet of steel to be used to prevent the passage of a bullet through a panel. When striking the steel, the panel is deflected about its adjacent flexing joints (ridges) to substantially reduce the remaining energy of the bullet.

Another particularly useful application of the present invention is in the construction of panels for access floors (which often have to withstand high impact loads and high point loads with minimal deflection).

These illustrative uses of the present invention are not intended to be limiting.

I claim:

1. A tile for use in the construction of a false floor, the tile comprising a rectangular tray made from a strong sheet material into which concrete has been cast, characterised in that (a) the floor of the rectangular tray is shaped to provide a ridge which extends across a diagonal of the tile, the ridge having a cross-sectional shape which is the shape of an inverted V, and (b) under the application of pressure to the tile, the region of the tile on one side of the ridge is moveable about an axis which coincides with the crest of the ridge, relative to the region of the tile on the other side of the ridge.

2. A tile for use in the construction of a false floor, comprising a rectangular tile of concrete supported within a tray of strong sheet material, characterised in that (a) the tile is divided into a 2×2 array of sub-tiles by a pair of inverted v-shaped ridges in the tray, each ridge extending in a direction which is parallel to two sides of the tile and at right angles to the direction in which the other ridge extends; and (b) the region of the tray which comprises the base of each sub-tile is shaped to provide an inverted v-shaped ridge, extending along a diagonal of the sub-tile.

3. A tile as defined in claim 1, in which the ratio of the height of the ridge to the thickness of the concrete is at least 2:3.

4. A tile as defined in claim 1, in which the tray is formed from a material in the group consisting of pressed steel and a hard plastics material.

5. A tile as defined in claim 1, in which the concrete is a pliable concrete.

6. A tile as defined in claim 1, in which at least one shear pin extends from the floor of the tray into the concrete.

7. A tile as defined in claim 6, in which the shear pin comprises a hollow cylindrical member which terminates in at least three outwardly turning ears at the end of the shear pin which is remote from the floor of the tray.

8. A tile as defined in claim 1, in which the tray has side walls which are shaped to form a returned rebate.

9. A tile as defined in claim 8, including an edge strip mounted on the side walls.

10. A tile as defined in claim 2, in which the ratio of the height of the ridge to the thickness of the concrete is at least 2:3.

11. A tile as defined in claim 10, in which the tray is formed from a material in the group consisting of pressed steel and a hard plastics material, and in which the concrete is a pliable concrete.

12. A tile as defined in claim 2, in which at least one shear pin extends from the floor of the tray into the concrete.

13. A tile as defined in claim 12, in which the shear pin comprises a hollow cylindrical member which terminates in at least three outwardly turning ears at the end of the shear pin which is remote from the floor of the tray.

14. A tile as defined in claim 13, in which the tray has side walls which are shaped to form a returned rebate.

15. A tile as defined in claim 14, including an edge strip mounted on the side walls.

* * * * *